US006996972B2

(12) United States Patent
Song

(10) Patent No.: US 6,996,972 B2
(45) Date of Patent: Feb. 14, 2006

(54) METHOD OF IONIZING A LIQUID PROPELLANT AND AN ELECTRIC THRUSTER IMPLEMENTING SUCH A METHOD

(75) Inventor: Weidong Song, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/709,620

(22) Filed: May 18, 2004

(65) Prior Publication Data

US 2005/0257515 A1 Nov. 24, 2005

(51) Int. Cl.
*F03H 5/00* (2006.01)

(52) U.S. Cl. ..... 60/202; 60/204

(58) Field of Classification Search ..... 239/3, 239/696; 60/202, 204
See application file for complete search history.

(56) References Cited

U.S. PATENT DOCUMENTS 3,017,115 A * 1/1962 Artman et al. ..... 239/3
3,117,029 A * 1/1964 Hines ..... 118/621
3,262,262 A * 7/1966 Reader et al. ..... 60/202
3,311,772 A * 3/1967 Speiser et al. ..... 313/361.1
3,552,124 A * 1/1971 Banks et al. ..... 60/202
3,573,977 A * 4/1971 Banks ..... 427/126.2
3,744,247 A * 7/1973 Margosian et al. ..... 60/202
5,211,006 A 5/1993 Sohnly
5,239,820 A 8/1993 Leifer et al.
6,516,604 B1 2/2003 Mojarradi et al.
2003/0209005 A1 * 11/2003 Fenn ..... 60/203.1
2004/0226279 A1 * 11/2004 Fenn ..... 60/203.1

* cited by examiner

*Primary Examiner*—Ehud Gartenberg
(74) *Attorney, Agent, or Firm*—Artz & Artz, PC

(57) ABSTRACT

A method of ionizing a liquid propellant is disclosed herein. The method includes the steps of applying an electrical charge to a showerhead, delivering a liquid propellant under pressure into a chamber defined within the showerhead, and emitting the liquid propellant under pressure through a plurality of micro-nozzles interspaced within the face of the showerhead to create a plurality of jets that collectively produce an electrospray having charged particles. An electric thruster that implements such a method is also disclosed herein. The thruster includes a showerhead having an inlet and a plurality of micro-nozzles, a reservoir for supplying propellant to the showerhead via the inlet, means for accelerating charged particles, and a power source connected to the showerhead and the accelerating means. The propellant is emitted under pressure from the micro-nozzles to produce an electrospray having charged particles. The charged particles are accelerated by the accelerating means to produce thrust.

16 Claims, 4 Drawing Sheets

METHOD OF IONIZING A LIQUID PROPELLANT AND AN ELECTRIC THRUSTER IMPLEMENTING SUCH A METHOD

BACKGROUND OF INVENTION

The present invention generally relates to propulsion systems for use onboard spacecraft. The present invention more particularly relates to electric thrusters for positioning and translating such spacecraft in space.

Prior to embarking on a space mission, a spacecraft must be equipped with enough propulsion capability to travel through and maneuver within space in order to carry out the mission. To help provide sufficient propulsion, engineers often include thrusters incorporating electric propulsion systems onboard spacecraft, for electric propulsion systems have been shown to produce exhaust velocities of about 10 to 20 kilometers per second (km/s), or even higher. In producing such high exhaust velocities, the amount of propellant required onboard a spacecraft for a given mission is significantly reduced.

Electric propulsion systems generally fall into three main categories. These categories include electrothermal propulsion systems, electromagnetic propulsion systems, and electrostatic propulsion systems. In electrothermal propulsion systems, a propellant undergoes thermodynamic expansion via controlled thermal heating. In this way, the resultant propellant gas is accelerated until it ultimately reaches a certain exhaust velocity as naturally dictated by gas thermodynamics. In electromagnetic propulsion systems, a propellant is converted into plasma (i.e., an ionized gas), and the plasma is accelerated via an electromagnetic field into a high-velocity exhaust stream. In electrostatic propulsion systems, a propellant is converted into electrically charged ions (i.e., a plasma), and the charged ions are accelerated via an electrostatic field into a high-velocity exhaust stream.

In recent years, the utilization of electrospray techniques as means for ionizing a liquid propellant and producing charged particles for electric propulsion has received considerable attention. In a conventional electrospray technique, a slightly conductive electrolytic liquid is channeled through a capillary needle and emitted from a tip opening in the needle. A strong electrostatic field is applied at the needle tip opening and causes an imbalance of surface force due to the accumulation of charges on the surface of the emitted liquid. If both the flow rate of the liquid and the electric field at the needle tip opening are maintained at proper levels or strengths, a liquid cone commonly referred to as a "Taylor cone" is thereby formed at the needle tip along with a jet issuing from the cone's apex. As the jet travels away from the Taylor cone, the jet eventually becomes unstable and separates into a spray of charged droplets. In this form, the spray of charged droplets, or "electrospray," is said to be in a "cone-jet mode."

To date, electrospray techniques have been utilized in thrusters incorporating electrostatic colloid propulsion systems. In general, a colloid thruster is a specific type of electrostatic thruster that utilizes an electrostatic field to accelerate numerous charged liquid drops (i.e., a colloid beam) emitted from a Taylor cone to thereby generate thrust. Typically, an array of emitters consisting of several hundreds of capillary needles is utilized in an individual colloid thruster. When equipped with such emitter arrays, research has shown that colloid thrusters are individually able to deliver thrust levels ranging as high as up to several hundreds of micro-newtons ($\mu$N). At such thrust levels, the high-performance propulsion of some small size spacecraft for precision positioning in space is thereby made possible.

In light of the above, it is desirable to further explore the potential benefits of utilizing electrospray techniques in electric propulsion systems for positioning or translating a spacecraft in space.

SUMMARY OF INVENTION

The present invention provides a method of ionizing a liquid propellant. In one practicable methodology, the method basically includes the steps of (1) applying an electrical charge to a showerhead, (2) delivering a liquid propellant under pressure into a chamber defined within the showerhead, and (3) emitting the liquid propellant under pressure through a plurality of micro-nozzles interspaced within the face of the showerhead to create a plurality of jets that collectively produce an electrospray having charged particles.

The present invention also provides a showerhead for implementing the above-described ionization method. In one practicable embodiment, the showerhead basically includes an enclosure and a plurality of micro-nozzles. The enclosure has an outer wall, a chamber defined within the outer wall, and an inlet defined through the outer wall. The micro-nozzles are collectively interspaced within the outer wall. Situated as such, the micro-nozzles provide fluid communication between the chamber and the outside of the showerhead. In a preferred embodiment, each of the micro-nozzles has an inner surface that is substantially convergent and physically shaped and sized to resemble a jet-producing Taylor cone.

The present invention also provides an electric thruster that implements the above-described ionization method. In one practicable embodiment, the electric thruster basically includes a showerhead, a reservoir, a means for accelerating charged particles, and a power source. The showerhead has an inlet and a plurality of micro-nozzles, and the reservoir serves to supply propellant to the showerhead via the inlet. The power source is connected to the showerhead and the accelerating means. Within such a configuration, the propellant is emitted under pressure from the micro-nozzles to produce an electrospray having charged particles. The charged particles are accelerated by the accelerating means to produce thrust.

The present invention also provides an electromagnetic thruster that implements the above-described ionization method. In one practicable embodiment, the electromagnetic thruster basically includes two showerheads, a reservoir, a power source, and a magnetic field generator. The two showerheads each have an inlet and a plurality of micro-nozzles. The showerheads are arranged so that they at least partially face each other and cooperatively define a gap. The reservoir serves to supply propellant to the two showerheads via their respective inlets. The power source is connected to the two showerheads and serves to create an electric field in the gap. The magnetic field generator serves to create a magnetic field in the gap. Within such a configuration, the propellant is emitted under pressure from the micro-nozzles to produce an electrospray having charged particles in the gap. The electric field and the magnetic field cooperatively induce a Lorentz force that accelerates the charged particles to produce thrust.

The present invention also provides an electrostatic thruster that implements the above-described ionization method. In one practicable embodiment, the electrostatic thruster includes a showerhead, a reservoir, a substantially planar structure, and a power source. The showerhead has an inlet and a plurality of micro-nozzles, and the reservoir serves to supply propellant to the showerhead via the inlet. The planar structure has a plurality of holes defined therethrough and is arranged to at least partially face the showerhead and therewith cooperatively define a gap. The power source is connected to the showerhead and the planar structure and thereby serves to create an electric field in the gap. Within such a configuration, the propellant is emitted under pressure from the micro-nozzles to produce an electrospray having charged particles in the gap. The charged particles are electrostatically accelerated across the gap and through the holes of the planar structure to produce thrust.

Furthermore, it is believed that various alternative embodiments, methodologies, design considerations, applications, and advantages of the present invention will become apparent to those skilled in the art when the detailed description of the best mode contemplated for practicing the invention, as set forth hereinbelow, is reviewed in conjunction with the appended claims and the accompanying drawing figures.

BRIEF DESCRIPTION OF DRAWINGS

The present invention is described hereinbelow, by way of example, with reference to the following drawing figures.

DETAILED DESCRIPTION

Figure 1:
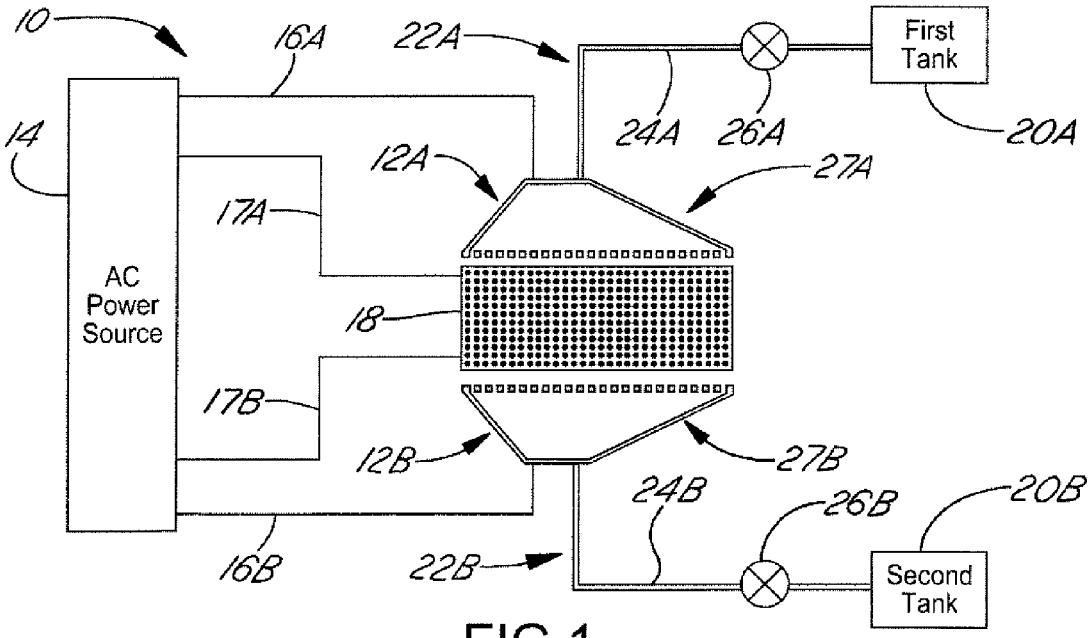
FIG. 1 is a system diagram of an electromagnetic thruster useful for positioning and translating a spacecraft in space. In the diagram, the electromagnetic thruster is shown to include an alternating-current electrical power source along with two showerheads.

FIG. 1 is a system diagram of an electromagnetic thruster 10 useful for positioning and translating a spacecraft in space. As shown in the diagram, the electromagnetic thruster 10 primarily includes two showerheads 12A and 12B, a power source 14, a magnetic field generator 18, two tanks 20A and 20B, and two conduit-and-valve systems 22A and 22B.

Figure 6:
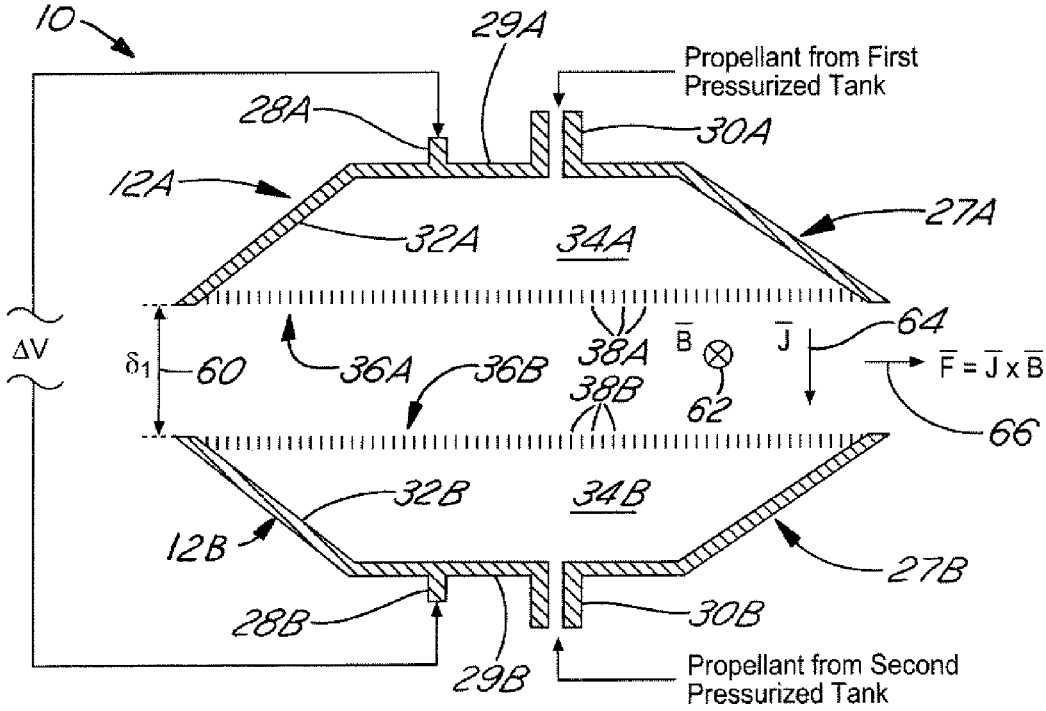
FIG. 6 is a sectional diagram of the two showerheads depicted in FIG. 1. In the diagram, the showerheads are shown separated by a gap in which both an electric field and a magnetic field are created, thereby inducing a Lorentz force for producing thrust.

The two showerheads 12A and 12B largely comprise electrically conductive material. As shown in FIGS. 1 and 6, the two showerheads 12A and 12B are arranged such that they at least partially face each other and cooperatively define a gap ($\delta_1$) 60. Within such a configuration, the two showerheads 12A and 12B primarily serve as emitters for dispensing amounts of ionized propellant (i.e., plasma) into the gap 60. For this reason, the two showerheads 12A and 12B are frequently referred to as "plasma shower-heads."

Figure 7:
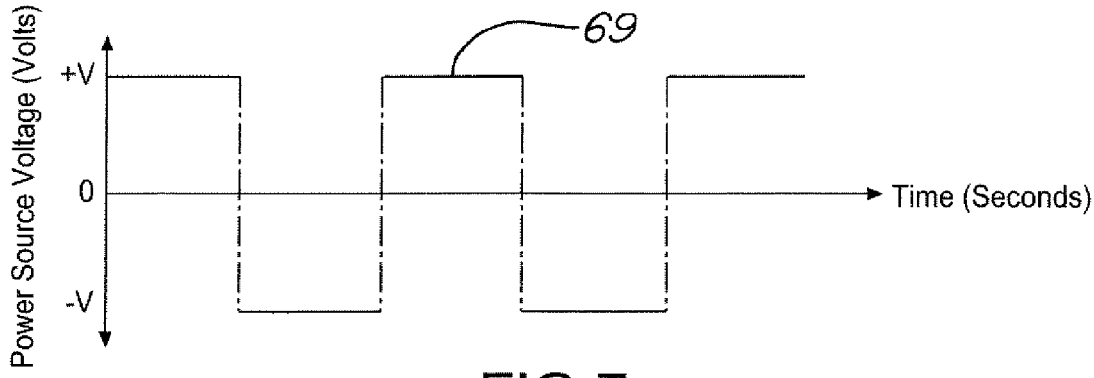
FIG. 7 is a waveform diagram of the voltage produced by the alternating-current electrical power source depicted in FIG. 1.

The power source 14, as shown in FIGS. 1 and 6, is electrically interconnected between the two showerheads 12A and 12B via two electrical conductors 16A and 16B at electrical connection points 28A and 28B. Connected as such, the power source 14 serves to establish a difference in voltage potentials between the two showerheads 12A and 12B. In this way, an electric field (E) is created in the gap 60. Although the power source 14 may be a direct-current (DC) electrical power source, the power source 14 is preferably an alternating-current (AC) electrical power source. FIG. 7 shows, by way of example, a waveform diagram of an output voltage signal 69 produced by the power source 14. As shown in the diagram, the output voltage signal 69 is preferably a rectangular or square wave signal that alternates in magnitude between +V and V voltage levels (for example, +1000 volts and 1000 volts).

The magnetic field generator 18, as shown in FIG. 1, is electrically connected to the power source 14 via two electrical conductors 17A and 17B. In one practicable embodiment, the magnetic field generator 18 includes at least one magnetic solenoid that is electrically energized by the power source 14 and situated about the gap 60 defined by the two showerheads 12A and 12B. Since the power source 14 is preferably an AC-type power source, the magnetic field generator 18 operates to create a time-varying magnetic field (B) (i.e., an "applied field") in the gap 60. In this way, both the strength and the direction of the magnetic field are largely controlled in a time-dependent manner. In another practicable embodiment, the magnetic field generator 18 may alternatively include a "self-field" system. In such a system, a magnetic field may instead be derived, for example, from an ion current sustained in the gap 60 between the two showerheads 12A and 12B.

The two tanks 20A and 20B are preferably pressurized and together serve as one or more reservoirs for preliminarily storing liquid propellant. As shown in FIG. 1, each of the tanks 20A and 20B is dedicated to supplying propellant under pressure to a different one of the two showerheads 12A and 12B. The stored propellant is preferably substantially inert and electrically conductive in nature. Most preferably, the propellant has a conductivity (K) of at least 1 siemens per meter (S/m). In some working scenarios, the propellant may even have a conductivity of 10 S/m or higher. Given such preferred characteristics, the propellant may comprise an electrolyte or an electrolytic solution such as, for example, salt water or a tributyl phosphate solution. As an alternative, the propellant may even comprise a liquid metal such as, for example, lithium or mercury.

The two conduit-and-valve systems 22A and 22B, as shown in FIG. 1, are connected between the two showerheads 12A and 12B and the two tanks 20A and 20B. As shown in FIGS. 1 and 6, the first conduit-and-valve system 22A is dedicated to communicating propellant under pressure from the first tank 20A and to an inlet 30A associated with the first showerhead 12A. The second conduit-and-valve system 22B is dedicated to communicating propellant under pressure from the second tank 20B and to an inlet 30B associated with the second showerhead 12B. To facilitate communication of the propellant in a controlled manner, each of the two conduit-and-valve systems 22A and 22B includes a conduit 24 and at least one flow control valve 26.

Figure 2A:
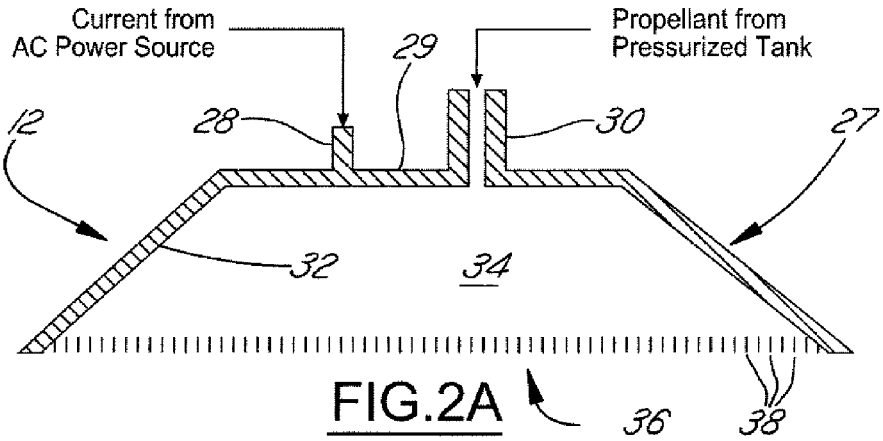
FIG. 2A is a sectional diagram of one of the two showerheads depicted in FIG. 1. In the diagram, the showerhead is shown to have a plurality of micro-nozzles.

FIG. 2A is a sectional diagram of one of the two showerheads 12A and 12B depicted in FIG. 1. As shown in the diagram, the showerhead 12 includes an enclosure 27 and a plurality of micro-nozzles 38. The enclosure 27 has an electrically conductive outer wall 29, a chamber 34 defined within the outer wall 29, and an inlet 30 defined through the outer wall 29. The micro-nozzles 38 are collectively interspaced within a planar section of the outer wall 29 so as to define a face 36 on the showerhead 12. Together, the micro-nozzles 38 provide fluid communication between the chamber 34 and the outside of the showerhead 12.

Figure 2B:
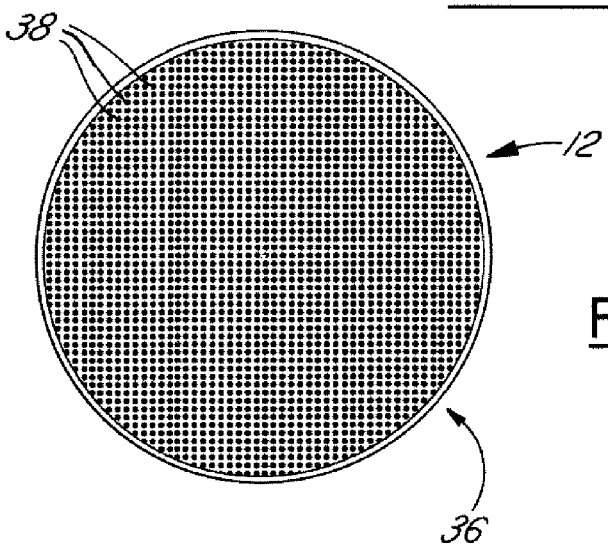
FIG. 2B is a plan diagram showing the face of the showerhead depicted in FIG. 2A. In the diagram, the micro-nozzles are shown interspaced within the face of the showerhead.

FIG. 2B is a plan diagram showing the face 36 of the showerhead 12 depicted in FIG. 2A. As shown in the diagram, the micro-nozzles 38 are preferably defined within the face 36 of the showerhead 12 such that the micro-nozzles 38 are spaced apart in a substantially even or array-like fashion. With the micro-nozzles 38 arranged in this manner, a showerhead 12 may include hundreds of micro-nozzles 38 within its face 36. Given such a configuration, a showerhead 12 can emit large quantities of ionized propellant into the gap 60. Though the face 36 of the showerhead 12 is substantially circular as depicted in F*igure* 2B, the face 36 in other embodiments may take on various other geometries.

Figure 3A:
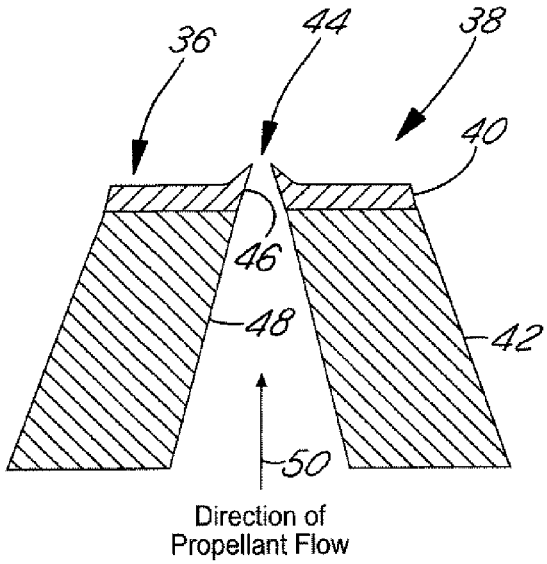
FIG. 3A is a sectional diagram of one of the micro-nozzles depicted in FIGS. 2A and 2B. In the diagram, the micro-nozzle is shown to have a convergent inner surface along with a tip outlet.

FIG. 3A is a sectional diagram of one of the micro-nozzles 38 depicted in FIGS. 2A and 2B. In the diagram, the face 36 of the showerhead 12 is shown to include an electrically conductive (i.e., metallic) layer 42 that is substantially coated with a relatively thin insulative layer 40. With the face 36 layered as such, the micro-nozzle 38 is defined through both the conductive layer 42 and the insulative layer 40 so as to form a tip outlet 44 that egresses into the gap 60. As further shown, the micro-nozzle 38 is formed so as to include both a convergent inner surface 48 associated with the conductive layer 42 and a convergent inner surface 46 associated with the insulative layer 40. The inner surface 48 associated with the conductive layer 42 is conterminous with the inner surface 32 of the chamber 34, and the inner surface 46 associated with the insulative layer 40 is conterminous with the inner surface 48. Formed as such, the micro-nozzle 38 therefore has an overall inner surface that is substantially frustum-shaped or conic with a truncated apex that generally coincides with the tip outlet 44. Most preferably, the overall inner surface of the micro-nozzle 38 is shaped such that it substantially resembles a jet-producing Taylor cone. Shaped as such, propellant is able to flow through the micro-nozzle 38 in a direction 50 and be emitted into the gap 60 via the tip outlet 44.

Coating the face 36 of each showerhead 12 with an insulative layer 40 as shown in FIG. 3A is generally preferred. In this way, as the power source 14 creates an electric field in the gap 60 during operation, the emission of electrons into the gap 60 from the outer surface of the conductive layer 42 associated with the face 36 of the negatively charged showerhead 12 is largely prevented. In preventing the emission of electrons from the negatively charged showerhead 12, an ion current produced and sustained within the gap 60 is kept from becoming unbalanced in mass.

The tip outlet 44 of each micro-nozzle 38 within the face 36 of each showerhead 12 preferably has an inner diameter of less than about 10 micrometers ($\mu$m), and most preferably an inner diameter of less than about 100 nanometers (nm). Sized as such, each tip outlet 44 approximates the initial diameter of a jet produced from the apex of a conventional liquid Taylor cone. With the tip outlet 44 of each micro-nozzle 38 having such a diminutive inner diameter, each showerhead 12 is able to help maintain an "active electrospray ionization mode" of operation for the thruster 10. In this mode of operation, the kinetic energy of the propellant as it is emitted under pressure from a showerhead 12 significantly contributes to the ultimate formation of electrospray in the gap 60. As a result, a cumulative electrospray of sufficient size is attained for propulsion.

During operation of the thruster 10, the two conduit-and-valve systems 22A and 22B communicate controlled amounts of propellant from the two tanks 20A and 20B and to the chambers 34A and 34B of the two showerheads 12A and 12B. With the power source 14 electrically interconnected between the two showerheads 12A and 12B, the showerheads 12A and 12B take on different voltage potentials, thereby establishing a voltage drop between the two showerheads 12A and 12B. In establishing such a voltage drop, the two showerheads 12A and 12B function as two electrodes between which an electric field is created. Since the power source 14 is an AC-type power source, the two showerheads 12A and 12B continuously exchange roles, on a periodic basis, in functioning as either the positively charged electrode or the negatively charged electrode. As a result, the electric field between the two showerheads 12A and 12B continuously changes direction, on a periodic basis, as well.

As the free-moving ions in the propellant interact with the electric field created in the chambers 34A and 34B of the electrically charged showerheads 12A and 12B, these propellant ions are electrically redistributed within the chambers 34A and 34B. In the positively charged showerhead 12, positive ions are "pulled"(i.e., attracted) toward the tip outlets 44 of the micro-nozzles 38, and negative ions are "pushed" (i.e., repelled) away from the tip outlets 44 of the micro-nozzles 38 and back into the chamber 34. At the same time, in the negatively charged showerhead 12, negative ions are pulled toward the tip outlets 44 of the micro-nozzles 38, and the positive ions are pushed away from the tip outlets 44 of the micro-nozzles 38 and back into the chamber 34. With the propellant being maintained under a pressure within the chambers 34A and 34B that is greater than the pressure of the outside surrounding environment, the resultant high-pressure gradients within the micro-nozzles 38A and 38B force amounts of ion-redistributed propellant to flow out through the micro-nozzles 38A and 38B of both showerheads 12A and 12B. As amounts of propellant are simultaneously emitted from the two showerheads 12A and 12B in this manner, two active streams of electrospray are produced in the gap 60. Due to the redistribution of the propellant ions just prior to such emission, one of the two active streams of electrospray has a positive net charge while the other of the two active streams has a negative net charge. While having these opposite net charges, the two active streams of electrospray move toward each other in the gap 60 so as to cooperatively sustain an ion current that flows between the two showerheads 12A and 12B via ionic conduction. As the showerheads 12A and 12B continue exchanging their positive and negative electrode roles as periodically dictated by the AC power source 14, the ion current flowing between the two showerheads 12A and 12B accordingly changes direction, on a periodic basis, as well.

Also during operation, the magnetic field generator 18 creates a time-varying magnetic field in and/or about the gap 60 separating the two showerheads 12A and 12B. The magnetic field generator 18 is particularly situated about the gap 60 to ensure that the direction of the magnetic field is substantially perpendicular to the directions of both the electric field and the ion current created and sustained between the two showerheads 12A and 12B. In directing the magnetic field in this manner, the interaction between the magnetic field and the ion current in the gap 60 naturally gives rise to a Lorentz force. This Lorentz force, represented as vector cross-product quantity $\bar{F}$, is generally defined as $$\underline{F}32\ \underline{J}\times\underline{B} \quad (1)$$

wherein $\underline{I}$ is a vector quantity representing the electric current density of the ion current in the electrospray, and $\underline{B}$ is a vector quantity representing the directed magnetic field. The Lorentz force forcefully interacts with the charged particles in the streams of electrospray. Through such forceful interaction, the Lorentz force accelerates the charged particles into a common, high-velocity exhaust stream to produce thrust. To ensure that the thrust-producing exhaust stream is maintained in the same direction with respect to the thruster 10, the magnetic field generator 18 is designed to operate in sync with the AC power source 14. In this way, the magnetic field correspondingly reverses direction as the AC power source 14 switches the respective charge polarities of the two showerheads 12A and 12B.

Figure 3B:
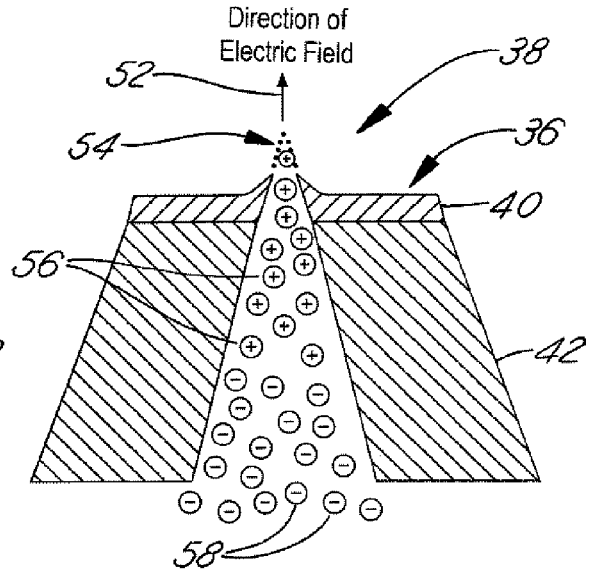
FIG. 3B is a sectional diagram of the micro-nozzle depicted in FIG. 3A. In the diagram, a propellant with redistributed ions is being emitted under pressure from the micro-nozzle, thereby forming a largely nozzle-confined liquid cone at the tip outlet of the micro-nozzle.

FIG. 3B is a sectional diagram of the micro-nozzle 38 depicted in FIG. 3A. In the diagram, propellant is being emitted under pressure from the micro-nozzle 38 of an electrically charged showerhead 12. As shown, the propellant forms a Taylor-like liquid cone 54 at the tip outlet 44 of the micro-nozzle 38 during emission. With the overall inner surface of the micro-nozzle 38 shaped and sized to resemble a Taylor cone, the liquid cone 54 is, overall, largely confined within the micro-nozzle 38 with only its apex extending beyond the tip outlet 44.

As also shown in FIG. 3B, the free-moving ions in the propellant are electrically redistributed within the micro-nozzle 38 due to the electrostatic forces present within the chamber 34 of the electrically charged showerhead 12. In the scenario depicted, the showerhead 12 along with the micro-nozzle 38 has, for the moment, been positively charged by the AC power source 14. With the showerhead 12 positively charged, the free-moving positive ions 56 in the propellant are electrostatically pulled toward the tip outlet 44 of the micro-nozzle 38 due to their attraction to the negatively charged showerhead 12 (not shown in FIG. 3B) situated across the gap 60. At the same time, the free-moving negative ions 58 in the propellant are electrostatically retained deep within the micro-nozzle 38 and in the chamber 34 of the positively charged showerhead 12. If the propellant, for example, largely comprises salt water, the positive ions 56 may include $Na^+$ ions, and the negative ions 58 may include $Cl^{31}$ ions. Ion redistribution within the micro-nozzles 38 and chamber 34 of the negatively charged showerhead 12 is carried out similarly, except that the positive ions 56 and the negative ions 58 therein are redistributed in an opposite manner.

By both causing ion redistribution and establishing pressure gradients within the chambers 34A and 34B of the two showerheads 12A and 12B, positive ions 56 along with liquid solvent are extracted (i.e., emitted) from the positively charged showerhead 12, and negative ions 58 along with liquid solvent are extracted from the negatively charged showerhead 12. In this way, two active streams of electrospray, one having a positive net charge and the other having a negative net charge, are simultaneously produced in the gap 60. These two active streams of electrospray cooperatively sustain an ion current that flows between the two showerheads 12A and 12B. As a result of such ion extraction, however, the propellant remaining in the positively charged showerhead 12 is left with a negative net charge, that is, an excess of negative ions. Similarly, the propellant remaining in the negatively charged showerhead 12 is left with a positive net charge, that is, an excess of positive ions. These net charges, though, exist only temporarily, for when the AC power source 14 soon thereafter switches the charge polarities on the two showerheads 12A and 12B, the remaining excesses of negative and positive propellant ions are then drawn and extracted respectively from the micro-nozzles 38A and 38B of the two showerheads 12A and 12B via convection. Thus, during operation of the thruster 10, any net charges left with the propellant remaining within the two showerheads 12A and 12B at a particular moment in time exist only temporarily, for such net charges are largely neutralized each time that the AC power source 14 reverses the charge polarities on the two showerheads 12A and 12B.

Figure 4:
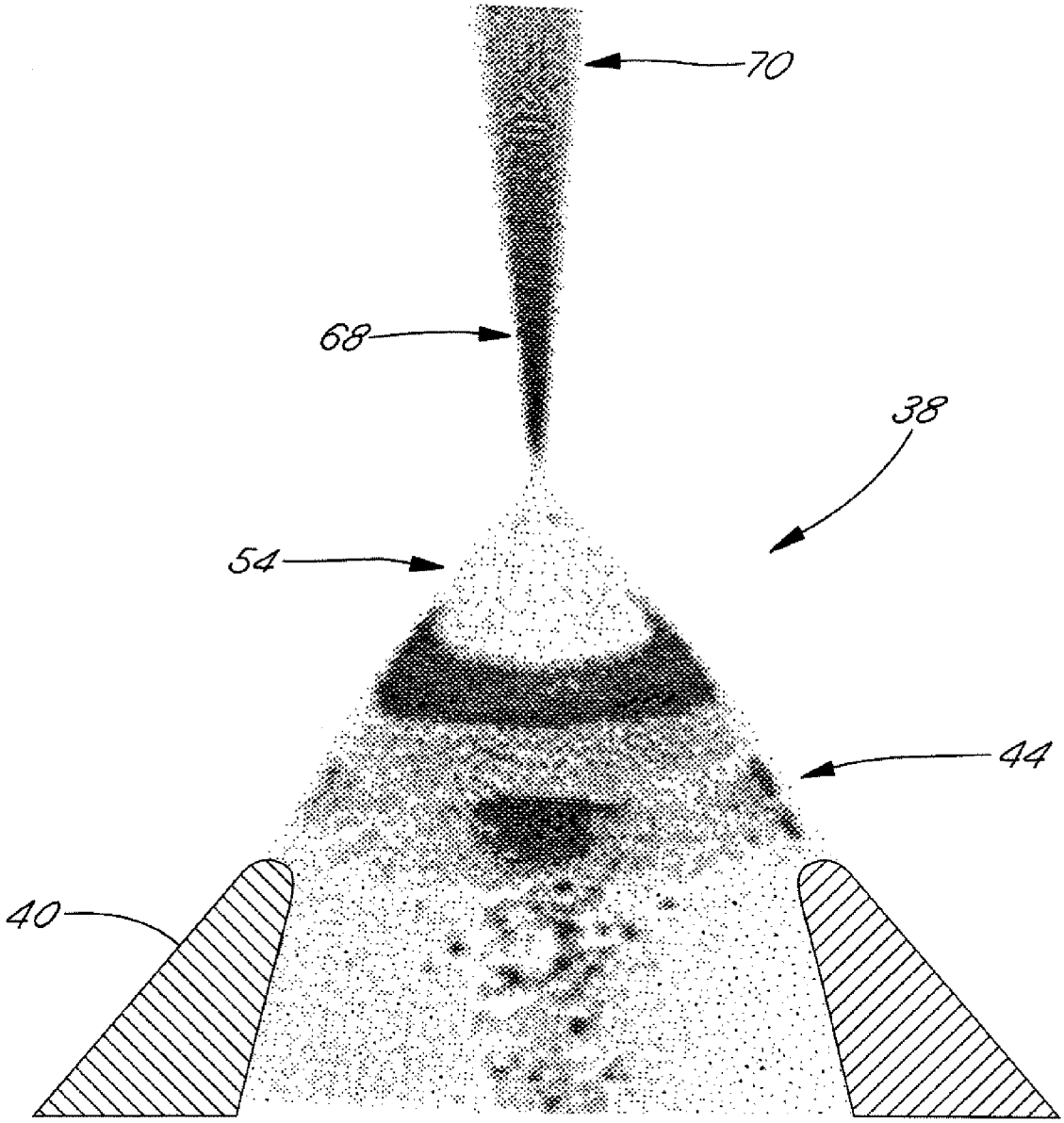
FIG. 4 is a sectional illustration of the tip outlet of the micro-nozzle depicted in FIG. 3B. In the illustration, a jet of electrospray is shown to issue forth from the apex of the liquid cone formed at the tip outlet.

FIG. 4 is a sectional illustration of the tip outlet 44 of the micro-nozzle 38 depicted in FIG. 3B. In the illustration, as in FIG. 3B, ion-redistributed propellant is being emitted under pressure from the micro-nozzle 38 of an electrically charged showerhead 12. As shown in detail, the propellant forms the Taylor-like liquid cone 54 at the tip outlet 44 of the micro-nozzle 38 during such emission. Since the overall inner surface of the micro-nozzle 38 is shaped and sized to resemble a Taylor cone, the liquid cone 54 is largely nozzle-confined with only its apex extending beyond the tip outlet 44 of the micro-nozzle 38. From the apex of the liquid cone 54, a jet 68 of propellant issues forth in a direction 52. As the jet 68 travels away from the liquid cone 54, the jet 68 eventually becomes unstable and separates into an electrospray 70. In this form, the electrospray 70 is considered to be in an "active-jet mode."

In the active-jet mode, ion-redistributed propellant is both electrostatically drawn and pressure-emitted from the micro-nozzles 38A and 38B of the two oppositely charged showerheads 12A and 12B. In this way, two active streams of electrospray, one having a positive net charge and the other having a negative net charge, are simultaneously produced in the gap 60. Together, these two active streams of electrospray cooperatively sustain an ion current that flows between the two showerheads 12A and 12B. Creating and sustaining an ion current via one or more active streams of electrospray in this manner is herein termed "active electrospray ionization." During active electrospray ionization, the high-level kinetic energies of the pressurized propellant contribute more significantly in the formation of the two streams of electrospray than do the electrostatic forces existing in and between the electrically charged showerheads 12A and 12B. With the micro-nozzles 38 each physically resembling a jet-producing Taylor cone, the liquid cones 54 formed at the tip outlets 44 of the micro-nozzles 38 are able to actively remain stable despite the high-level kinetic energies of the pressurized propellant. In general, such stability is largely attributable to the nozzle-confined nature of each liquid cone 54. Given such a nature, each liquid cone 54 is able to actively remain stable even under high-rate and large volumetric flows of propellant that would cause a more conventional liquid Taylor cone to become unstable and break down. By actively remaining stable, the apex of each liquid cone 54 is able to properly form a jet 68 that successfully produces an electrospray 70 of charged particles.

During emission of the propellant while still in its liquid form, the propellant may at times need to be heated to a somewhat elevated temperature when moving through the chambers 34A and 34B and micro-nozzles 38A and 38B of the two showerheads 12A and 12B. In this way, for example, when the volatile liquid propellant is introduced into a vacuum (i.e., free space), the propellant is able to rapidly evaporate without freezing. To successfully heat the propellant to a somewhat elevated temperature, a conventional heating system may be situated within or about the two showerheads 12A and 12B, the two conduit-and-valve systems 22A and 22B, and/or the two tanks 20A and 20B. Situated as such, the heating system should generally maintain the liquid propellant at a temperature T, in accordance with the following equation, to prevent the propellant from freezing.

$$(T-T_0)*C_P>h \tag{2}$$

In this equation, T is the temperature of the propellant prior to evaporation, $T_0$ is the characteristic freezing point of the propellant in a vacuum, $C_P$ is the characteristic specific heat of the propellant at constant pressure, and h is the energy required to transform a unit mass of liquid to a vapor of the same temperature T.

The two active streams of electrospray produced by the two showerheads 12A and 12B include various charged particles. If the propellant is, for example, saturated salt water ($NaCl+H_2O$), the cumulative electrospray produced in the gap 60 is likely to include at least four primary categories of charged particles. These four categories include individual ions, water molecules, solvated ions, and charged droplets.

The individual ions present in an electrospray produced from such a saltwater propellant generally include $Na^+$ ions, $Cl^-$ ions, $H^+$ ions, and $OH^-$ ions. In general, the presence of individual ions existing separately within an electrospray has been observed in various different electrospray experiments. In particular, electrospray regimes largely consisting solely of ions without any accompanying spray droplets have been produced from liquid metal and some electrolytes such as $H_2SO_4$ (sulfuric acid) and $EMIBF_4$ (an ionic liquid). In producing such electrospray regimes, the liquid solvent rapidly evaporates upon initial emission. For a high-conductivity propellant solution such as saturated salt water, the liberation of individual ions from the liquid domain via evaporation may take place directly from an electrified liquid surface. As a result, ion currents having a positive net charge (i.e., a positive mode), a negative net charge (a negative mode), or a combination of both can be produced and sustained. Depending on ion mobility, activation energy, and other factors, the magnitudes of an ion current in a positive mode versus a negative mode may differ slightly. However, experimental results have demonstrated that this slight magnitude difference is largely negligible when all other conditions are substantially similar. In sum, therefore, such results indicate that oppositely charged ion currents, one in a positive mode and the other in a negative mode, can be emitted respectively from two facing showerheads so as to sustain a common ion current therebetween in a balanced manner.

In addition to individual ions, water molecules ($H_2O$) are also likely to be present in an electrospray produced from such a saltwater propellant. In fact, water molecules are likely to comprise a large fraction of the particles that are present within the electrospray. Such is primarily due to the fact that water molecules make up a large part of the liquid solvent portion of the saltwater propellant during its initial storage in a propellant reservoir or tank 20.

Figure 5A:
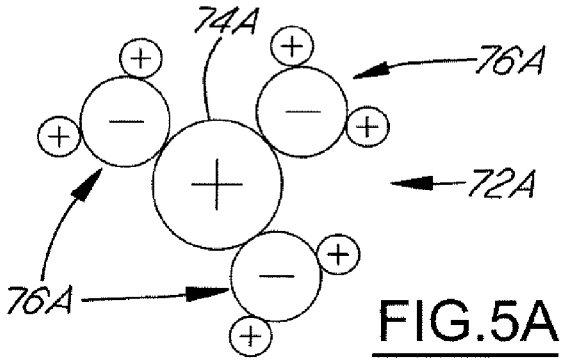
FIG. 5A is a molecular diagram depicting a solvated ion included within the electrospray of FIG. 4. In the diagram, the solvated ion is shown to include a positive ion along with three polarized solvent molecules.
Figure 5B:
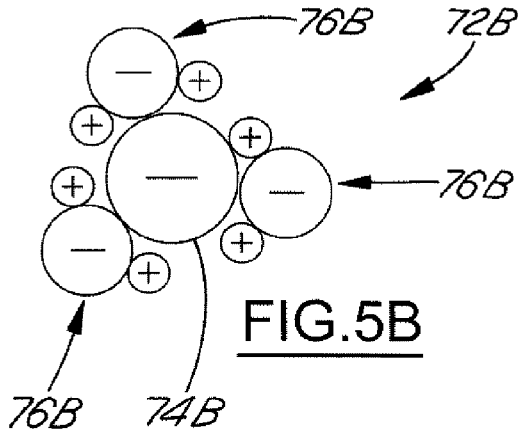
FIG. 5B is a molecular diagram depicting another solvated ion included within the electrospray of FIG. 4. In the diagram, the solvated ion is shown to include a negative ion along with three polarized solvent molecules.

Along with individual ions and water molecules, ions with multiple water molecules attached thereto (i.e., solvated ions) are also likely to be present in an electrospray produced from such a saltwater propellant. That is, given that water molecules are naturally polarized, it is likely that some water molecules will be attracted to positive or negative ions within the saltwater propellant and attach themselves thereto. In FIG. 5A, for example, a molecular diagram of a solvated ion 72A that includes multiple polarized water molecules 76A attached to a positive ion 74A is therein depicted. The positive ion 74A itself may particularly be a $Na^+$ ion. In such a case, the solvated ion 72A may be expressed in formulaic terms as $$Na^+ + nH_2O \tag{3}$$

wherein n is a positive integer. In FIG. 5B, as another example, a molecular diagram of another solvated ion 72B that includes multiple polarized water molecules 76B attached to a negative ion 74B is therein depicted. The negative ion 74B itself may particularly be a $Cl^-$ ion. In such a case, the solvated ion 72B may be expressed in formulaic terms as $$Cl^- + nH_2O \tag{4}$$

wherein n is a positive integer. Given that the overall mass of each solvated ion is largely attributable to water, solvated ions are generally not governed by Rayleigh stability criteria.

In addition to individual ions, water molecules, and solvated ions, charged droplets are also likely to be present in an electrospray produced from such a saltwater propellant. The presence of charged droplets is partly due to the relatively high volumetric flow rate of propellant that is characteristic of an electrospray produced in the active-jet mode. Furthermore, with the presence of a strong electric field established by the oppositely charged showerheads 12A and 12B, ions are electrostatically pulled to the apex of each largely nozzle-confined liquid cone 54 and transported downstream via a jet 68. As each jet 68 issues forth and moves away from the apex of its associated liquid cone 54, each jet 68 eventually becomes unstable and separates into very fine droplets having ions trapped inside. The mass-to-charge ratio (m/q) of each such charged droplet is limited by the Rayleigh stability criterion $$m/q \geq A\rho\gamma^{-1/2}r^{3/2} \quad (5)$$

wherein A is a dimensional coefficient, ρis the liquid density, γis the surface tension, and r is the droplet radius. In general, this stability criterion equation delimits the minimum possible mass-to-charge ratio, expressed as a function of droplet size and surface tension, for maintaining stability. The life cycle of each charged droplet is typically quite short due to the high volatility of water in a vacuum. In particular, the high volatility of water causes charged droplets to quickly evaporate, thereby separating the charged droplets into ions and water molecules. Liberation of ions from water molecules in this manner, however, is desirable, for such helps ensure that an increased number of free ions are present in the electrospray. In addition, as charged droplets are separated into free ions and water molecules, some neutral water molecules are also ionized into free $H^+$ and $OH^-$ ions due to the high-energy collisions between the free ions and the neutral molecules. As a result, an even higher number of free ions are present in the electrospray, and a desirable level of propulsion is ultimately realized.

In the active-jet mode, a relatively low-temperature electrospray of charged particles is produced. In particular, by utilizing a highly conductive solution as a propellant, the electrospray produced in the active-jet mode largely includes a low-temperature, high specific charge, and well-organized mixture of solvated ions and charged droplets. Such a mixture of charged particles is herein referred to as "cold plasma." Within such a "well-organized" mixture, the ions characteristically have very little random thermal motion, and the overall velocity of the mixture is very uniformly distributed. In producing such a low-temperature and well-organized mixture of charged particles, the resultant cold plasma flow can therefore be controlled very easily and ultimately accelerated to produce thrust. In addition, such a well-organized cold plasma flow also has the ability to carry a relatively high current density. Hence, in producing such a cold plasma flow, the thruster 10 is able to produce a relatively high thrust density.

FIG. 6 is a sectional diagram of the two showerheads 12A and 12B depicted in FIG. 1. In the diagram, the two showerheads 12A and 12B cooperatively define, and are thereby separated by, the gap ($\delta_1$) 60. In the gap 60, both an electric field (E) and a magnetic field (B) are created, thereby giving rise to a Lorentz force (F). The electric field is created by the AC power source 14 that is electrically interconnected between the two showerheads 12A and 12B. The "accelerating" magnetic field is created by the magnetic field generator 18. Once induced, the Lorentz force forcefully interacts with the charged particles in the streams of electrospray that are emitted from the two showerheads 12A and 12B. Through such forceful interaction, the Lorentz force is able to accelerate the charged particles into a common, high-velocity exhaust stream in a single direction 66. In addition, neutral particles in the electrospray may also be accelerated into the exhaust stream via momentum exchange between the high-velocity charged particles and low-velocity neutral particles. In this way, per conservation of linear momentum, thrust is ultimately produced in a direction that is opposite to the direction 66.

In the scenario depicted in FIG. 6, the showerhead 12A has, for the moment, been positively charged by the AC power source 14, and the showerhead 12B has, for the same moment, been negatively charged by the AC power source 14. With the showerhead 12A positively charged, an active stream of electrospray having a positive net charge is emitted therefrom and into the gap 60. At the same time, with the showerhead 12B negatively charged, an active stream of electrospray having a negative net charge is emitted therefrom and into the gap 60. In simultaneously producing the two streams of electrospray, an ion current (I) of a particular current density (J) is thereby sustained between the two oppositely charged showerheads 12A and 12B. With the showerhead 12A momentarily being positively charged and the showerhead 12B momentarily being negatively charged, the ion current is thereby made to flow in a direction 64 per the definition of "conventional current flow." While the ion current is flowing in the direction 64, the magnetic field generator 18 directs the magnetic field (B) in a direction 62 (into the paper of FIG. 6) that is substantially perpendicular to the direction 64 of the ion current. In this way, according to the Lorentz force equation (1) and the "right-hand rule" of vector cross-product quantities, the resultant Lorentz force is directed in the direction 66.

In FIG. 6, when the AC power source 14 soon thereafter switches the respective charge polarities of the two showerheads 12A and 12B, the ion current in the gap 60 then correspondingly changes and flows in a direction that is opposite to the direction 64. With the magnetic field generator 18 closely operating in sync with the AC power source 14, the magnetic field in the gap 60 is correspondingly re-directed so as to flow in a direction that is opposite to the direction 62. By re-directing the magnetic field in this manner each time that the power source 14 switches the charge polarities of the two showerheads 12A and 12B, the resultant Lorentz force along with the thrust-producing exhaust stream is always maintained in the same direction 66. In this way, thrust is accordingly always maintained in a direction that is opposite to the direction 66.

In general, active electrospray ionization technology is ideal for being implemented within electric propulsion systems such as electromagnetic propulsion systems or electrostatic propulsion systems, as well as in thrusters or thrusting engines incorporating such systems. With regard to electromagnetic propulsion systems, the technology may be implemented within, for example, magnetoplasmadynamic (MPD) propulsion systems or pulsed plasma thruster (PPT) systems. The electromagnetic thruster 10 depicted in FIGS. 1 and 6 is a particular example of a thruster that incorporates such an MPD propulsion system implementing active electrospray ionization technology. With regard to electrostatic propulsion systems, the technology may be implemented within, for example, colloid propulsion systems.

Figure 8:
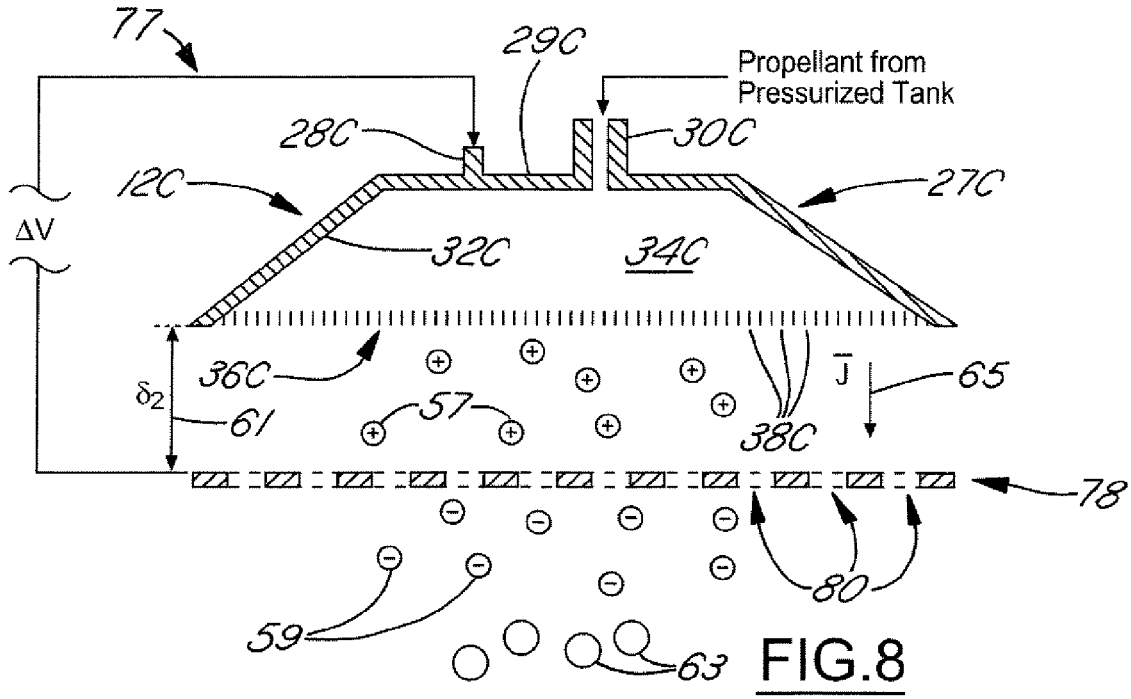
FIG. 8 is a sectional diagram of an electrostatic thruster useful for positioning and translating a spacecraft in space. In the diagram, the electrostatic thruster is shown to include a showerhead along with a substantially planar structure having a plurality of holes.

FIG. 8 is a sectional diagram of an electrostatic thruster 77 useful for positioning and translating a spacecraft in space. As indicated in the diagram, the electrostatic thruster 77 primarily includes a showerhead 12C, a tank (i.e., reservoir), a substantially planar structure 78, and a power source. The showerhead 12C has an inlet 30C and a plurality of micro-nozzles 38C, and the tank serves to supply propellant under pressure to the showerhead 12C via the inlet 30C. The planar structure 78 has a plurality of holes 80 defined therethrough and is arranged to at least partially face the showerhead 12C and therewith cooperatively define a gap ($\delta_2$) 61. The power source is preferably an AC electrical power source and is electrically interconnected between the showerhead 12C and the planar structure 78. Connected as such, the power source serves to establish a difference in voltage potentials between the showerhead 12C and the planar structure 78 and thereby create an electric field (E) in the gap 61. In general, the showerhead 12C, the tank, and the power source of the electrostatic thruster 77 are all constructed similar to the showerheads 12A and 12B, the power source 14, and the tanks 20A and 20B of the electromagnetic thruster 10 in FIGS. 1 and 6.

Figure 9:
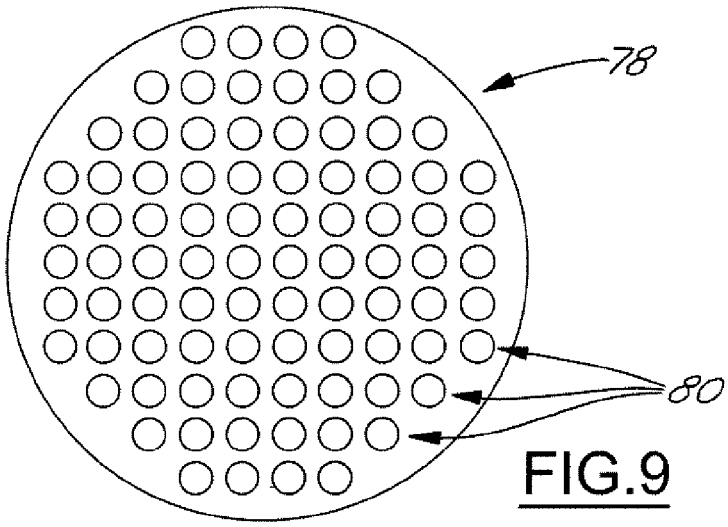
FIG. 9 is a plan diagram of the planar structure depicted in FIG. 8.

FIG. 9 is a plan diagram of the planar structure 78 depicted in FIG. 8. As shown in the diagram, the planar structure 78 is basically a hole-riddled plate wherein the holes 80 are spaced apart in a somewhat array-like fashion. The planar structure 78 itself largely comprises electrically conductive material and is therefore able to retain an electrical charge. In alternative embodiments, the planar structure 78 may instead be an electrically conductive grid or screen.

In the scenario depicted in FIG. 8, the showerhead 12C has, for the moment, been positively charged by the AC power source, and the planar structure 78 has, for the same moment, been negatively charged by the AC power source. In the positively charged showerhead 12C, free-moving ions in the propellant are electrically redistributed within the chamber 34C such that positive ions are "pulled" toward the tip outlets 44 of the micro-nozzles 38C, and negative ions are "pushed" away from the tip outlets 44 of the micro-nozzles 38C and back into the chamber 34C. Due to the pressure gradients existing in both the chamber 34C and the micro-nozzles 38C, an active stream of electrospray (i.e., cold plasma) is emitted under pressure from the face 36C of the showerhead 12C and into the gap 61. With the showerhead 12C momentarily being positively charged and the planar structure 78 momentarily being negatively charged, the active stream of electrospray has a positive net charge, for the charged particles in the electrospray largely include redistributed positive ions 57 which are electrostatically attracted to the negatively charged planar structure 78. Due to the force of such electrostatic attraction, the positive ions 57 are accelerated across the gap 61 and toward the planar structure 78 in a substantially streamlined fashion. In this way, a positive ion current (I) of current density 0), flowing in a direction 65, is sustained between the showerhead 12C and the planar structure 78. Upon reaching the planar structure 78, the positive ions 57 pass through the holes 80 within the planar structure 78, thereby forming a high-velocity exhaust stream of particles. In this way, thrust is ultimately produced in a direction that is opposite to the direction 65.

In FIG. 8, when the AC power source soon thereafter switches the respective charge polarities of the showerhead 12C and the planar structure 78, free-moving ions in the propellant are then electrically redistributed within the chamber 34C such that negative ions are pulled toward the tip outlets 44 of the micro-nozzles 38C, and positive ions are pushed away from the tip outlets 44 of the micro-nozzles 38C and back into the chamber 34C. Due to the existing pressure gradients, an active stream of electrospray continues to be emitted under pressure from the face 36C of the showerhead 12C and into the gap 61. With the showerhead 12C momentarily being negatively charged and the planar structure 78 momentarily being positively charged, the active stream of electrospray then has a negative net charge, for the charged particles in the electrospray largely include redistributed negative ions 59 which are electrostatically attracted to the positively charged planar structure 78. Due to the force of such electrostatic attraction, the negative ions 59 are accelerated across the gap 61 and toward the planar structure 78, thereby sustaining a negative ion current, flowing in a direction 65, between the showerhead 12C and the planar structure 78. Upon reaching the planar structure 78, the negative ions 59 pass through the holes 80 within the planar structure 78, thereby further contributing to the high-velocity exhaust stream of particles. In this way, thrust is produced and further maintained in a direction that is opposite to the direction 65. In producing successive exhaust streams of positive and negative particles in such a continuous and uninterrupted manner, the particles effectively neutralize each other, thereby yielding an overall exhaust plume of particles 63 that is largely electrically neutral.

In sum, some characteristics of the active electrospray ionization technology disclosed herein are as follows. First, the technology generally utilizes a conductive (for example, $K \geqq 1$ S/m) ionic solution as a propellant. In some working scenarios, a propellant having a conductivity of 10 S/m or higher may even be utilized. Such a propellant is both artificially heated as needed and emitted from an electrically charged showerhead under a strong pressure gradient. Second, the propellant is emitted from the showerhead via numerous convergent micro-nozzles having tip outlets with inner diameters on the order of about 1 micrometer or less, and most preferably on the order of about 10 nanometers or less. Third, the inner surfaces of the micro-nozzles are both shaped and sized to resemble liquid Taylor cones. Shaped and sized as such, the stabilities of jet-producing liquid cones are successfully maintained, even under large volumetric propellant flow rates and large pressure gradients, by being largely physically confined within the micro-nozzles. In maintaining the stabilities of the liquid cones, the jets issuing therefrom are able to successfully produce a fine electrospray outside the showerhead. Fourth, active electrospray ionization technology significantly relies on both kinetic energy and electrostatic force for ionizing the propellant. As a result, the technology generally consumes modest amounts of energy while generating relatively large quantities of electrospray. Fifth, in utilizing a highly conductive solution as a propellant, active electrospray ionization technology generates an electrospray having a high charge-to-mass (q/m) ratio and is therefore capable of producing both high levels of thrust and high specific impulse ($I_{SP}$) levels. In being able to produce high levels of thrust and $I_{SP}$, a thruster incorporating an electric propulsion system that implements active electrospray ionization technology is therefore suitable for positioning or translating a spacecraft in space. Sixth, the produced electrospray includes a low-temperature, high specific charge, and well-organized mixture of solvated ions and charged droplets (i.e., cold plasma). In producing such a mixture of charged particles, the resultant cold plasma flow can easily be controlled and ultimately accelerated to produce thrust while, at the same time, causing fewer erosion-related problems and less energy dissipation through ohmic heating. Seventh, given the overall simplicity of active electrospray ionization technology, a thruster incorporating an electric propulsion system that implements such technology is characteristically reliable, relatively small and lightweight, and also generally inexpensive.

While the present invention has been described in what are presently considered to be its most practical and preferred embodiments or implementations, it is to be understood that the invention is not to be limited to the particular embodiments disclosed hereinabove. On the contrary, the present invention is intended to cover various modifications and equivalent arrangements included within the spirit and scope of the claims appended hereinbelow, which scope is to be accorded the broadest interpretation so as to encompass all such modifications and equivalent structures as are permitted under the law.

What is claimed is:

1. A method of ionizing a liquid propellant, said method comprising the steps of:

(a) applying an electrical charge to a showerhead;

(b) delivering a liquid propellant under pressure into a chamber defined within said showerhead; and (c) emitting said liquid propellant under pressure through a plurality of micro-nozzles interspaced within the face of said showerhead to create a plurality of jets that collectively produce an electrospray having charged particles;

wherein said showerhead has an electrically conductive face and an electrically insulative layer substantially coating said face, and each of said micro-nozzles is defined through both said electrically conductive face and said electrically insulative layer; and wherein each of said micro-nozzles has an inner surface that is substantially convergent.

2. An ionization method according to claim 1, wherein step (a) is accomplished with a power source selected from the group consisting of a direct-current electrical power source and an alternating-current electrical power source.

3. An ionization method according to claim 1, wherein said showerhead comprises electrically conductive material.

4. An ionization method according to claim 1, wherein said micro-nozzles are substantially evenly spaced apart within said face.

5. An ionization method according to claim 1, wherein said liquid propellant comprises an electrically conductive solution having a conductivity of at least 1 siemens per meter.

6. An ionization method according to claim 1, wherein said liquid propellant comprises an electrolyte.

7. An ionization method according to claim 1, wherein said liquid propellant is substantially inert.

8. An ionization method according to claim 1, wherein said liquid propellant comprises salt water.

9. An ionization method according to claim 1, wherein said liquid propellant comprises a tributyl phosphate solution.

10. An ionization method according to claim 1, wherein said liquid propellant comprises a liquid metal selected from the group consisting of lithium and mercury.

11. An ionization method according to claim 1, wherein said inner surface of each of said micro-nozzles has a shape resembling a structure selected from the group consisting of a cone and a frustum.

12. An ionization method according to claim 1, wherein said inner surface of each of said micro-nozzles has a shape resembling a Taylor cone.

13. An ionization method according to claim 1, wherein each of said micro-nozzles has a tip outlet with an inner diameter of less than about 10 micrometers.

14. An ionization method according to claim 1, wherein each of said micro-nozzles has a tip outlet with an inner diameter of less than about 100 nanometers.

15. An ionization method according to claim 1, wherein said electrospray comprises charged particles selected from the group consisting of charged droplets, individual ions, solvated ions, solvent molecules, and mixtures thereof.

16. An ionization method according to claim 1, said method further comprising the step of heating said liquid propellant to thereby elevate and maintain the temperature of said liquid propellant above the characteristic freezing point of said liquid propellant in a vacuum.

* * * * *